United States Patent [19]

Furusawa et al.

[11] 4,207,448

[45] Jun. 10, 1980

[54] PUSHBUTTON SWITCH

[75] Inventors: Akira Furusawa; Yutaka Udagawa, both of Tokyo, Japan

[73] Assignee: Oki Electric Industry Co., Ltd., Tokyo, Japan

[21] Appl. No.: 917,851

[22] Filed: Jun. 22, 1978

[30] Foreign Application Priority Data

Jun. 29, 1977 [JP] Japan ..... 52-76592

[51] Int. Cl.[2] ..... H01H 1/06; H01H 3/12

[52] U.S. Cl. ..... 200/159 B; 200/275

[58] Field of Search ..... 200/159 B, 159 A, 275, 200/292, 340

[56] References Cited

U.S. PATENT DOCUMENTS

| | | | |
|---|---|---|---|
| 3,133,170 | 5/1964 | Nanninga | 200/159 B X |
| 3,950,627 | 4/1976 | Murata et al. | 200/159 R |
| 3,973,091 | 8/1976 | Kaminski | 200/159 B X |
| 3,995,126 | 11/1976 | Larson | 200/159 B X |
| 3,996,429 | 12/1976 | Chu et al. | 200/159 A X |
| 4,005,293 | 1/1977 | Boulanger | 200/159 B X |
| 4,056,700 | 11/1977 | Stannek | 200/275 X |

*Primary Examiner*—Steven M. Pollard

*Attorney, Agent, or Firm*—Peter L. Berger

[57] ABSTRACT

A pushbutton switch is disclosed which comprises a dome-shaped buckling plate spring between a fixed contact on a printed circuit board and a common conductive sheet. The curvature of the plate spring is reversed so as to obtain an electrical communication.

13 Claims, 11 Drawing Figures

PUSHBUTTON SWITCH

BACKGROUND OF THE INVENTION

A. Field of the Invention

The present invention relates to a pushbutton switch which utilizes a buckling plate spring, or more particularly, to an improvement of a pushbutton switch for obtaining electrical contact by reversing the curvature of the dome-shaped buckling plate spring.

B. Description of the Prior Art

In vibratory vehicles, ships, or electric products for domestic use, a pushbutton switch is utilized in which a buckling plate spring is provided because of contact ability as well as human engineering. The normal upwardly concave curvature of the buckling plate spring is reversed to a lower concave curvature upon application of preselected load by the fingertips of an operator, and the displacement of the buckling plate spring advances if the load is loosened, thereby obtaining an electrical communication.

In the prior art pushbutton switch U.S. Pat. No. 3,725,907, as shown in a plan view partly cut away of FIG. 1 or in a vertical section of FIG. 2, a common conductive member 2 and an individual fixed contact 3 are provided on a printed circuit board 1. A conductive dome-shaped click spring 5 whose central portion 4 is curved upwardly is inserted in an insulating spacer 7 which has a retaining hole 6. The peripheral or circumferential edge 8 of the click spring 5 is mounted on the above-said rectangular common conductive member 2, and a dust sheet 9 for environmental seal is overlaid on a central portion 4. A pushbutton 12 which has a flange 10 and a protruding portion 11 is carried within a cover 13 which is put on the dust sheet 9.

The click spring 5 is constructed of a buckling plate spring which, as shown in a load to displacement diagram of FIG. 3, increases its displacement to a certain extent (b) even if a load by a fingertip of an operator to the pushbutton 12 is slackened once the load exceeds a limit (a), while automatically returning to its original state by its own restorative force. The protruding portion 12 causes, via the dust sheet 9, the central portion 4 of the click spring 5 to reverse its curvature through depression of the pushbutton 12 by the operator so that an electrical contact or communication between the common conductive member 2 and the fixed contact 3 is obtained. When communicated, a repulsive force of the click spring 5 to the fingertip of the operator is abruptly decreased (hereinafter called "click effect"), therefore, the switching action can be acknowledged. Once the operator releases the pushbutton 12, the click spring 5 automatically restores to its original state in order to break the electrical communication between the common conductive member 2 and the fixed contact 3.

But, there are many defects in the pushbutton switch as described hereinunder.

First, the contact function tends to degradate or a contact fault to occur. Namely, on every switching action, the circumferential edge 8 of the metal click spring 5 slides on the metal common conductive member 2 which is provided on the print circuit board 1. Accordingly, the sliding portion of each is abraded to cause the degradation of the contact function, moreover, contact fault is caused by the metal filings which are produced through the above-said abrasion. Said contact fault is conspicuous when the common conductive member 2 is printed on the printed circuit board 1 as a circuit pattern.

Secondly, the cost of the production is expensive and a high degree of precision as well as numerous man-hours are required in manufacturing. Namely, the large number of parts increase the manufacturing cost, because the common conductive member 2 and the fixed contact 3 are manufactured as individual parts. Besides, in arranging both of them on the printed circuit board 1, it is necessary to bring both of them into close contact with the printed circuit board 1 so as to equalize the necessary force for depressing each pushbutton switch or corresponding displacement thereby for the before-mentioned click effect. Therefore, a high degree of precision and large number of man-hour are required, especially in manufacturing a key board in which many pushbuttons are provided.

Thirdly, the indicator of the switching action is uncertain. Namely, in the above-said pushbutton switch, the dust sheet 9, which is generally made of a plastic sheet and has a elasticity, is provided between the cover 13 and the spacer 7 in order to prevent the dust which intrudes from a space between the pushbutton 12 and the cover 13. The dust sheet 9 cushions the depressing force to the click spring 5 by the pushbutton 12, thereby the click effect which is characteristic of the pushbutton switch is offset. The chain line of FIG. 3 indicates the offset of the click effect and before-mentioned (a) shifts to (a'). In general, a stroke of the pushbutton 12 in a switching action depends on a throttle depth of the dome-shaped click spring 5 or an allowable stress of an employed material and is originally very short, compared with a cantilever switch. Therefore, the operator is uncertain of the indicator of the switching action.

Fourthly, the necessary force for depressing the pushbutton 12 and the click effect are of variable character. Namely, abovesaid retaining construction in which merely a part of the circumferential edge 8 of the click spring 5 is mounted on the common conductive member 2 often causes the variation because the click spring 5 has a specific roll direction of a spring material.

SUMMARY OF THE INVENTION

The present invention is directed to a novel pushbutton switch which comprises a dome-shaped buckling plate spring between a fixed contact on a printed circuit board and a common conductive sheet, and the curvature of the plate spring is revised in order to obtain an electrical communication.

In the pushbutton switch, the fixed contact is printed on the printed circuit board on which a spacer which has a retaining hole and a seating portion for mounting the click spring is overlaid. A common conductive sheet is put on the click spring and a pushbutton which has a protruding portion is carried within a cover. The fixed contact and the common conductive sheet are in a facing relationship via the click spring, and the click spring is depressed by the pushbutton.

The first object of the present invention is to prevent the degradation of the contact function as well as to prevent contact fault caused by an abrasion. To achieve the object, only the fixed contact is provided on the printed circuit board, and the common conductive sheet is opposed via the click spring to the fixed contact, and moreover, the click spring is mounted on the seating portion of the plastic spacer so as to eliminate a metal to metal abrasion in the switching action.

The second object is to lower the cost for production by decreasing the number of parts. To achieve the object, the fixed contact is printed on the printed circuit board and the common conductive sheet is utilized.

The third object of the invention is to facilitate the indicator of switching action by maintaining the click effect of the click spring properly. To achieve the object, the common conductive sheet is constructed of a metal foil and a top portion of the click spring protrudes from the surface of the spacer.

The fourth object is to stabilize the force necessary for depressing the pushbutton and the click effect by supporting the whole circumferential edge of the click spring steadily on the seating portion.

The fifth object is to lower the cost of production by the spacer which is constructed of a retaining plate and a seating plate.

The sixth object of the invention is to lower the cost of production by coating the spacer on the printed circuit board successively.

The seventh object is to prevent the damage of the common conductive sheet by giving the flexibility to the conductive sheet. To achieve the object, the common conductive sheet is constructed of a plastic film on which a conductive layer is adhered.

The eighth object is to prevent the above-said damage by increasing the flexibility of the common conductive sheet. To achieve the object, a desired pattern of conductive layer is adhered to the plastic film.

The ninth object is to facilitate the indicator of switching action by increasing the stroke of the pushbutton. To achieve the object, an elastic body such as a damper boss made of plastic sponge or a damper sheet is provided at a protruding portion of the pushbutton.

The above and further objects and novel features of the invention will more fully appear from the following detailed description when the same is read in connection with the accompanying drawings. It is to be understood, however, that the drawings are for purpose of illustration only and are not intended as definitions of the invention.

DETAILED DESCRIPTION OF PREFERRED EMBODIMENTS

Figure 1:
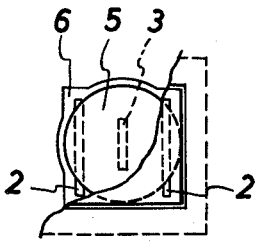
FIG. 1 PRIOR ART
FIG. 1 is a plan view partly cut away according to the prior art pushbutton switch.
Figure 4:
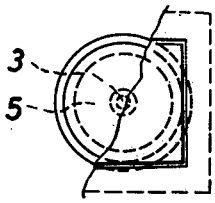
FIG. 4 is a plan view partly cut away according to an embodiment of the invention.
Figure 2:
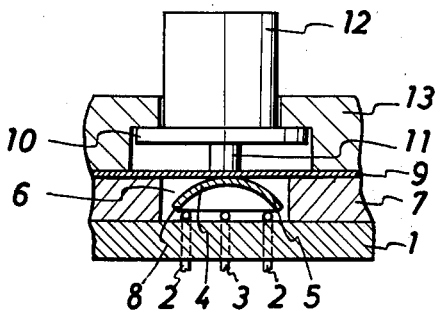
FIG. 2 PRIOR ART
FIG. 2 is a vertical section of FIG. 1.
Figure 5:
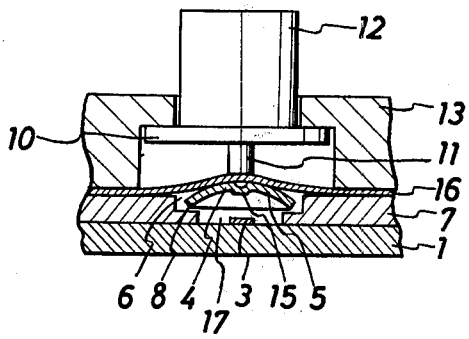
FIG. 5 is a vertical section of FIG. 4.
Figure 3:
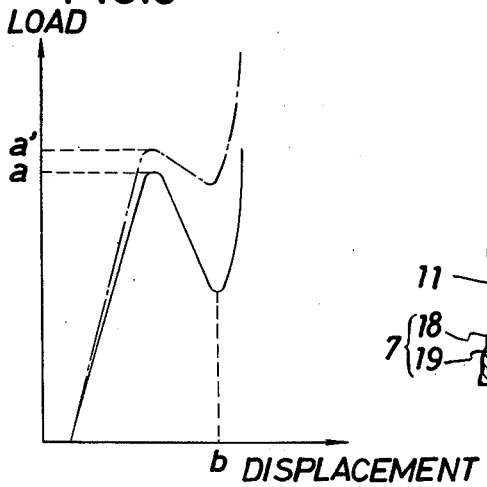
FIG. 3 is a load to displacement diagram of a click spring.
Figure 6:
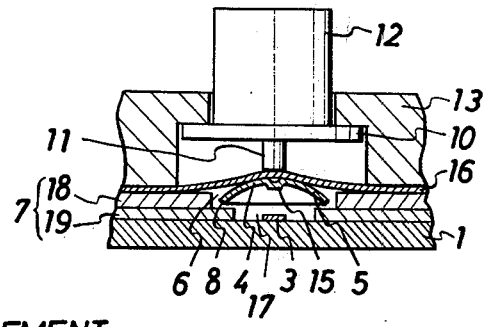
FIG. 6 is a vertical section of a pushbutton switch according to an embodiment of the invention in which a spacer is constructed of a retaining plate and a seating plate.

The present invention is described herein under with reference to FIGS. 5 and 6.

In these figures, numeral 1 indicates a printed circuit board on which a fixed contact 3 is printed, numeral 7 indicates a spacer made of a plastic in which a retaining hole 6 and a seating portion 14 is provided, numeral 5 indicates a click spring which is curved upwardly and constructed of a conductive dome-shaped plate spring with a contact protrusion 15 provided at a center portion 4. The circumferential edge 8 of the click spring 5 is mounted on the seating portion 14. Numeral 16 indicates a common conductive sheet which fills the role of a dust sheet at the same time, said conductive sheet 16 and the fixed contact 3 being in facing relationship via a click spring 5. Numeral 12 indicates a pushbutton in which a flange 10 and a protruding portion 11 are provided, said pushbutton 12 being carried within a cover 13. In the pushbutton switch, the fixed contact 3 and the contact protrusion 15 as well as the protruding portion 11 are in facing relationship. The fixed contact 3 is formed as a printed circuit pattern on the printed circuit board 1, and the connection between the fixed contact 3 and the outside is made by the printed circuit pattern. As described, by printing the fixed contact 3 as a circuit pattern, reduction of man-hours and relaxation of accuracy are achieved, and the cost of production can be lowered. The spacer 7 comprises the retaining hole 6 for inserting the click spring 5 at the opposite side of the fixed contact 3 and the seating portion 14 for supporting the whole circumference 8 of the click spring 5, and a through hole 17 is provided at the seating portion 14. The seating portion 14 supports the whole circumferential edge 8 of the click spring 5 uniformly so that the click effect of the click spring 5 is stabilized regardless of the roll direction. The spacer 7 prevents the degradation of contact fault caused by an abrasion because the spacer 7 is constructed of a plastic material which is of low friction and wear-proof. The click effect can be promoted by setting the supported height of the click spring 5 in the reverse by the seating portion 14 higher than the height of the fixed contact 3. Said supporting height is allowed a free choice in a range that the click spring 5 restores to its original state by its own restorative force after being reversed by the depression of the pushbutton 12. If the click effect is not so necessitated, the supporting height, namely the thickness of the seating portion 14 may be reduced to 0 so that the click spring 5 is mounted directly on the printed circuit board 1. But in that case, the fixed contact 3 and the printed circuit pattern coexist on the same plane, therefore a counterplan for insulation is required. The contact protrusion 15 of the click spring 5 is provided to improve the contact between the click spring 5 and the fixed contact 3, because the fixed contact 3 is constituted of a relatively large plane as a printed circuit pattern. And if needed, both of them may be plated by a noble metal in order to improve the contact ability. The common conductive sheet 16 is provided for electrically connecting with the outside via a lead wire as well as for filling the role of a dust sheet, and is constructed of a conductive metal foil, for example, an aluminum foil with a thickness of about 10 to 20 microns. By the way in the present embodiment, the central portion 4 of the click spring 5 is set higher than the upper surface of the spacer 7 in order to transmit the depression force of the protruding portion 11 to the central portion 4 of the click spring 5, without imposing upon the common conductive sheet 16 a force other than the bending force, namely the tensile force when the pushbutton is depressed. Thereby, the common conductive sheet 16 of metal foil which accommodates the bending force and is not durable to the tensile force is kept away from damage. Moreover, the click effect is not decreased because a repulsive force to the pushbutton 12 does not exist.

In operation, the depression force to the pushbutton 12 by a fingertip of an operator transmits from the protruding portion 11 to the central portion 4 via the common conductive sheet 16, and the click spring 5 which curves upwardly is reversed with the click effect to bring into contact the contact protrusion 15 with the fixed contact 3 on the printed circuit board 1. In this way, the common conductive sheet 16 is electrically connected with the fixed contact 3 via the click spring 5.

The pushbutton switch according to the present invention results in following achievements.

First, the degradation of contact function caused by abrasion as well as the contact fault caused by metal filings can be prevented, because only the fixed contact is provided on the orint circuit board, and the common conductive sheet is in facing relationship with the fixed contact via the spring, so that the click spring is mounted on the seating portion to avoid a metal to metal abrasion.

Secondly, the cost of production can be lowered as compared with the case that the fixed contact is made as individual parts, moreover, the accuracy as well as the number of man-hours can also be decreased in manufacturing, by providing the common conductive sheet and printing the fixed contact on the printed circuit board.

Thirdly, as the common conductive sheet is constructed of a metal foil and the central portion of the click spring is set higher than the upper surface of the spacer, then the click effect of the click spring can be maintained steadily, accordingly, the indication of the switching action is improved.

Fourthly, as the whole circumferential edge of the click spring is supported steadily on the seating portion, then the necessary force for depressing the pushbutton as well as the click effect can be stabilized regardless of the roll direction of spring material.

Reference is now made to FIG. 6 in which another embodiment of the invention is illustrated.

Figure 7:
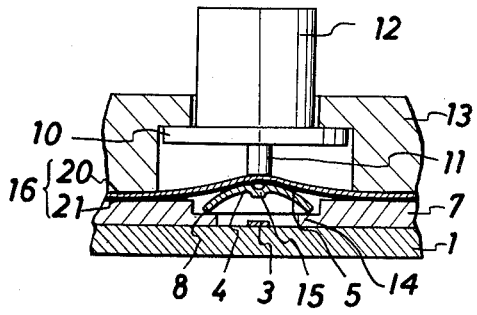
FIG. 7 is a vertical section according to an embodiment of the invention in which a common conductive sheet is constructed of a plastic film on which a conductive layer is adhered.

In the figure, numeral 18 indicates a plastic retaining plate whose thickness is smaller than the height of the click spring 5, and a retaining hole 6 which is larger than the diameter of the click spring 5 is provided. Numeral 19 indicates a seating plate whose thickness is greater than the height of the fixed contact 3, and a through hole 17 is provided which is smaller than the outside diameter of the click spring 5 but greater than that of the fixed contact 3. The spacer 7 is constructed by placing the retaining plate 18 on the seating plate 19 axially aligned with the center of the retaining hole 6 and with that of the through hole 17. Since the spacer 7 is constructed by piling up the plastic film in which holes are bored, accordingly, the productivity can be raised to lower the cost of production. Besides, the spacer 7 maybe constructed in such a way that, at first the plastic seating plate 19 is coated in a certain thickness on the printed circuit board 1, and then, the retaining plate 18 is coated likewise. Thereby, the productivity of the spacer 7 can be by far raised to lower the cost of production. A further embodiment of the invention is shown in FIG. 7. A conductive layer 21 is adhered or pressed to the lower surface of the plastic film 20, namely the contact side of the click spring 5 in order to form the common conductive sheet 16. The metal foil common conductive sheet 16 may have a difficulty in connecting with the outside because the thickness is of about 10 to 20 microns and the metal foil is easily damaged in switching action. As the base of the common conductive sheet 16 is the plastic film 20, the common conductive sheet 16 acquires the flexibility, accordingly, the common conductive sheet 16 is prevented from damage in long term switching action. Therefore, the connection with the outside is facilitated.

Figure 8:
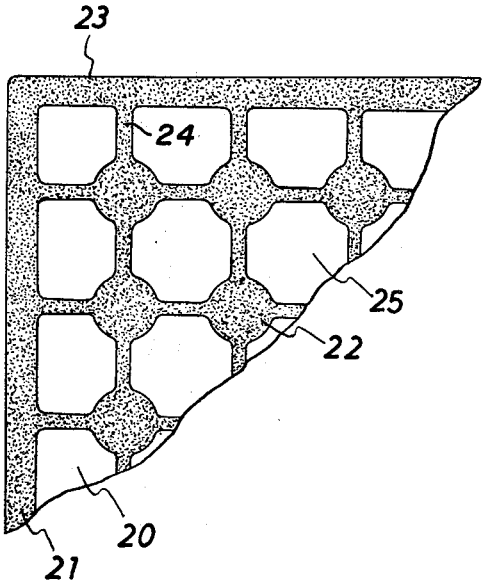
FIG. 8 is a plan view according to an embodiment of the invention in which a desired pattern of a plastic film is adhered to the plastic film.

A desired pattern of the conductive layer 21 may be adhered to the plastic film 20 by etching, as shown in FIG. 8, in order to improve the common conductive sheet 16. In the figure, numeral 22 indicates a contact portion for making contact with the click spring 5, numeral 23 indicates a connecting portion with the outside, numeral 24 indicates a coupling portion for making contact each contact portion with the connecting portion 23. Only these portions are made of the conductive layer 21, and other portion of the plastic film 20 are left as at blank 25. The flexibility of the common conductive sheet 16 can be improved because the flexibility of the plastic film 20 is maintained in the blank 25.

Figure 9:
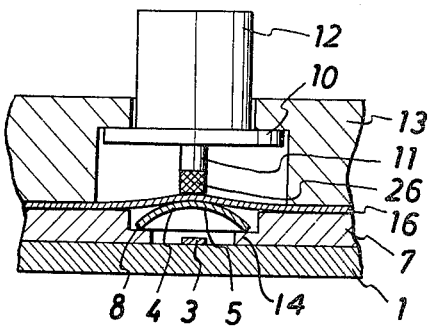
FIG. 9 is a vertical section according to an embodiment of the invention in which a damper boss is attached to the pushbutton.
Figure 11:
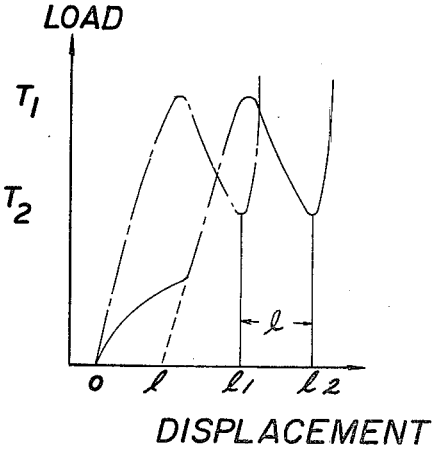
FIG. 11 is a load to displacement diagram when a damper sheet is provided.

Referring now to FIG. 9, another embodiment of the invention is illustrated. In the figure, a damper boss 26 made of an elastic body, for example, a plastic sponge is attached to the protruding portion 11 of the pushbutton 12. Though the stroke of the pushbutton switch with the click spring 5 is substantially short and the indication of switching action is uncertain, the damper boss 26 minimizes the uncertainty. FIG. 11 is a load to displacement diagram explanation. When the pushbutton 12 is depressed by an operator, only the damper boss 26 is compressed and the click spring 5 is not transformed at the start. On further depression, the click spring 5 starts the displacement, and then the damper boss 26 is completely compressed, only the click spring 5 is transformed to execute switching action. A load to displacement line is shifted by (L) by means of the provision of the damper boss 26. Therefore, the stroke of the pushbutton 12 is increased by (L) and the uncertainty of indication is eliminated.

Figure 10:
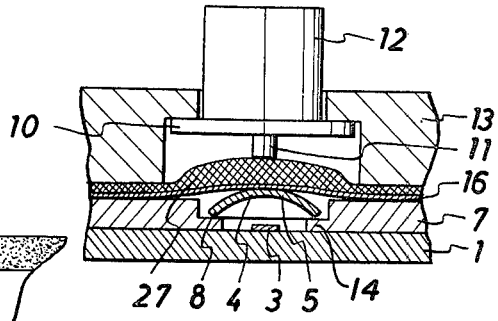
FIG. 10 is a vertical section according to an embodiment of the invention in which a damper sheet is provided.

Referring to FIG. 10, a damper sheet 27 of plastic sponge may be inserted between the protruding portion 11 of the pushbutton 12 and the common conductive sheet 16, in order to fill the roll as the damper boss 26. The cost of production can be decreased by the damper sheet 27 compared with the damper boss 26.

While there have been shown and described and pointed out the fundamental novel features of the invention as applied to preferred embodiments, it will be understood that the various omissions and substitutions and changes in the form and details of the mechanism and the operation may be made by those skilled in the art without departing from the spirit of the invention.

What is claimed is:

1. A pushbutton switch comprising a circuit board having a single fixed electrical contact embedded therein, a dome-shape conductive click spring positioned to touch said fixed electrical contact when said click spring curvature is reversed under influence of pressure, a common conductive sheet overlaying said click spring and forming an electrical contact to electrically connect with said embedded single electrical contact in said circuit board when the curvature of said click spring is reversed, a pushbutton located above said conductive sheet to bear on said dome-shape click spring to cause a reversal of said click spring curvature, spacer means located on said circuit board forming a recessed seating portion around said embedded electrical contact, said click spring having a circumferential edge seated in said recessed seating portion being retained therein to form said pushbutton switch, said recessed seating portion having a diameter larger than that of said click spring when said click spring is in its initial curvature so as to accommodate the enlarging diameter of said click spring when its curvature is reversed.

2. A pushbutton switch as set forth in claim 1, wherein the dome of said dome-shaped click spring is aligned with said fixed embedded electrical contact.

3. A pushbutton switch of claim 1, wherein the thickness of the spacer is set so that a top portion of the click spring is higher than the upper surface of the spacer.

4. A pushbutton switch of claim 1, wherein the seating portion is made of a wear-proof plastic material to support the peripheral edge of the click spring uniformly.

5. A pushbutton switch of claim 1, wherein the height of the click spring supported by the seating portion is set higher than that of the upper surface of the fixed contact.

6. A pushbutton switch of claim 1, wherein the spacer comprises retaining plate with the retaining hole and the seating plate forming the seating portion.

7. A pushbutton switch of claim 6, wherein the retaining plate and the seating plate comprise a wear-proof plastic material being coated.

8. A pushbutton switch of claim 1, wherein said board comprises a printed circuit board and the fixed contact is printed on the printed circuit board as a circuit pattern.

9. A pushbutton switch of claim 8, wherein a contact protrusion is provided at a central portion of the click spring.

10. A pushbutton switch of claim 1, wherein the common conductive sheet is constructed by attaching a conductive layer to a contact side of a plastic film.

11. A pushbutton switch of claim 1, wherein the conductive layer comprises an assembly sheet comprising a contact portion for making contact with the click spring, a connecting portion with the outside, a coupling portion for making contact with each contact portion, and an other portion being blank.

12. A pushbutton switch of claim 1, wherein a contact protrusion is provided at a central portion of the click spring, and a damper boss made of an elastic body is attached to said protruding portion.

13. A pushbutton switch of claim 1, further comprising a damper sheet located between the central portion of said click spring and the common conductive sheet.

* * * * *